US007668298B2

(12) United States Patent
Subraya et al.

(10) Patent No.: US 7,668,298 B2
(45) Date of Patent: Feb. 23, 2010

(54) SYSTEM AND METHOD FOR COLLECTING BACKSCATTERED ELECTRONS IN AN X-RAY TUBE

(75) Inventors: Madhusudhana T. Subraya, New Berlin, WI (US); Michael Scott Hebert, Franklin, WI (US); Gregory Alan Steinlage, Hartland, WI (US)

(73) Assignee: General Electric Co., Schenectady, NY (US)

( * ) Notice: Subject to any disclaimer, the term of this patent is extended or adjusted under 35 U.S.C. 154(b) by 28 days.

(21) Appl. No.: 12/039,737

(22) Filed: Feb. 29, 2008

(65) Prior Publication Data

US 2009/0052627 A1 Feb. 26, 2009

Related U.S. Application Data

(63) Continuation-in-part of application No. 11/306,233, filed on Dec. 20, 2005, now Pat. No. 7,359,486.

(51) Int. Cl.
*H01J 35/10* (2006.01)
*H01J 35/12* (2006.01)

(52) U.S. Cl. ..... 378/141; 378/142

(58) Field of Classification Search ..... 378/119, 378/121, 127, 128, 136–138, 140–144, 199, 378/200

See application file for complete search history.

(56) References Cited

U.S. PATENT DOCUMENTS

| | | | | |
|---|---|---|---|---|
| 3,609,432 | A | 9/1971 | Shimula | |
| 4,607,380 | A | 8/1986 | Oliver | |
| 5,828,727 | A | 10/1998 | Schild | |
| 5,995,585 | A | 11/1999 | Salasoo | |
| 6,115,454 | A | 9/2000 | Andrews et al. | |
| 6,215,852 | B1 | 4/2001 | Rogers et al. | |
| 6,263,046 | B1 | 7/2001 | Rogers | |
| 6,284,206 | B1 * | 9/2001 | Lesieur et al. | 422/198 |
| 6,301,332 | B1 * | 10/2001 | Rogers et al. | 378/142 |
| 6,307,916 | B1 | 10/2001 | Rogers et al. | |
| 6,385,292 | B1 | 5/2002 | Dunham et al. | |
| 6,400,799 | B1 * | 6/2002 | Andrews | 378/141 |
| 6,438,208 | B1 | 8/2002 | Koller | |
| 6,519,318 | B1 | 2/2003 | Andrews | |

(Continued)

FOREIGN PATENT DOCUMENTS

CH 663114 A5 11/1987

OTHER PUBLICATIONS

Shiffler, D., et al., "Advanced cathode and anode research at the Air Force Research Laboratory". Power Modulator Symposium, 2002 and 2002 High-Voltage Workshop, Conference Record of the Twenty-Fifth International, Jun. 30-Jul. 3, 2002, 712-715.

*Primary Examiner*—Edward J Glick
*Assistant Examiner*—Anastasia Midkiff

(57) ABSTRACT

A system and method for collecting backscattered electrons within a substantially evacuated vessel containing both an electron-emitting cathode assembly and an electron-attracting anode assembly. The system and method comprises an electron collector assembly including a first plate, a second plate, an internal member, a fluid inlet, and a fluid outlet. The first plate is mounted within the vessel closest to the anode assembly. The second plate is mounted within the vessel closest to the cathode assembly. The internal member is positioned between the first plate and the second plate, and includes an internal conduit for conveying a heat absorbing cooling fluid therethrough.

18 Claims, 5 Drawing Sheets

U.S. PATENT DOCUMENTS 6,690,765 B1 2/2004 Miller
6,714,626 B1 3/2004 Subraya et al.
6,922,463 B2 7/2005 Tang et al.
6,980,628 B2 12/2005 Wang et al.
7,042,981 B2 5/2006 Subraya et al.
7,359,486 B2 * 4/2008 Subraya et al. ..... 378/141
7,450,378 B2 * 11/2008 Nelson et al. ..... 361/689
2002/0085675 A1 7/2002 Snyder et al.
2002/0146092 A1 10/2002 Richardson et al.
2004/0071268 A1 4/2004 Subraya et al.
2004/0114724 A1 6/2004 Subraya et al.
2004/0223588 A1 11/2004 Subraya et al.

* cited by examiner

SYSTEM AND METHOD FOR COLLECTING BACKSCATTERED ELECTRONS IN AN X-RAY TUBE

CROSS-REFERENCE TO RELATED APPLICATIONS

This application is a continuation-in-part of and claims priority to U.S. patent application Ser. No. 11/306,233, filed on Dec. 20, 2005, the disclosure of which is incorporated herein by reference.

BACKGROUND OF THE INVENTION

The present disclosure relates generally to electron collectors, and more particularly to a system and method for collecting backscattered electrons within, for example, a substantially evacuated vessel, such as an x-ray tube.

An x-ray tube generally includes a cathode assembly and an anode assembly disposed within a vacuum vessel. The anode assembly includes an anode. The anode commonly includes a stationary or a rotating target with a target track or impact zone fabricated on an outer surface thereof. The target track or impact zone is generally fabricated from a refractory metal with a high atomic number, such as tungsten or a tungsten alloy. The cathode assembly is positioned at some distance from the anode assembly, and a high voltage differential is maintained therebetween in order to accelerate electrons toward the anode. This high voltage differential generates an electric field having a strength defined as the voltage differential between the anode and cathode divided by the distance therebetween. The cathode assembly emits electrons in the form of an electron beam that are accelerated across the high voltage differential and impact the target track at a focal spot at a high velocity. As the electrons impact the target track, the kinetic energy of the electrons is converted to high-energy electromagnetic radiation, or x-rays. The x-rays are then transmitted through an object and intercepted by a detector that forms an image of the object's internal structure and contents.

Many of the electrons incident on the anode target are backscattered from the anode's target track in random directions and scattered throughout the vacuum vessel to strike internal components of the x-ray tube. As these backscattered electrons impact internal components of the x-ray tube, their kinetic energies are transferred to these internal components in the form of thermal energy or heat. Excess heat generation adversely affects the durability of the x-ray tube. Furthermore, in addition to transferring thermal energy to the x-ray tube's internal components, the impact of backscattered electrons also produces off-focus x-ray radiation that may increase undesirable exposure to x-ray radiation and diminish x-ray image quality.

Therefore, there is a need for a system and method of improving the collection of backscattered electrons in an x-ray tube.

BRIEF DESCRIPTION OF THE INVENTION

In an exemplary embodiment, an electron collector assembly for collecting backscattered electrons within a substantially evacuated vessel that contains an electron-emitting cathode and an electron-attracting anode spaced apart therein, said electron collector assembly comprising a first plate mounted proximate to said anode within said vessel, said first plate having a first side at least partially facing said anode and a second side facing opposite said first side; a second plate mounted proximate to said cathode within said vessel, said second plate having a first side and a second side at least partially facing said cathode; an inner member positioned between said first plate and said second plate, said inner member having an internal conduit for conveying a heat absorbing cooling fluid therethrough; an inlet in fluid communication with said internal conduit; and an outlet in fluid communication with said internal conduit.

In an exemplary embodiment, an electron collector assembly for collecting backscattered electrons within a substantially evacuated vessel that contains an electron-emitting cathode and an electron-attracting anode spaced apart therein, said electron collector assembly comprising a first plate mounted proximate to said anode within said vessel, said first plate having a first side at least partially facing said anode and a second side facing opposite said first side; an inner member integral with said first plate, said inner member having an internal conduit for conveying a heat absorbing cooling fluid therethrough; a second plate mounted proximate to said cathode within said vessel, said second plate having a first side and a second side at least partially facing said cathode; an inlet in fluid communication with said internal conduit; and an outlet in fluid communication with said internal conduit.

In an exemplary embodiment, an electron collector assembly for collecting backscattered electrons within a substantially evacuated vessel that contains an electron-emitting cathode and an electron-attracting anode spaced apart therein, said electron collector assembly comprising a first plate mounted proximate to said anode within said vessel, said first plate having a first side at least partially facing said anode and a second side facing opposite said first side; a second plate mounted proximate to said cathode within said vessel, said second plate having a first side and a second side at least partially facing said cathode; an inner member integral with said second plate, said inner member having an internal conduit for conveying heat absorbing cooling fluid therethrough; an inlet in fluid communication with said internal conduit; and an outlet in fluid communication with said internal conduit.

In an exemplary embodiment, a system for collecting backscattered electrons within a substantially evacuated vessel containing both an electron-emitting cathode assembly and an electron-attracting anode assembly spaced apart therein, said system comprising a first plate mounted proximate to said anode assembly within said vessel, said first plate having a first side at least partially facing said anode assembly and a second side facing opposite said first side; a second plate mounted proximate to said cathode assembly within said vessel, said second plate having a first side and a second side at least partially facing said cathode assembly; and an inner member positioned between said first plate and said second plate, said inner member having an internal conduit for conveying heat absorbing cooling fluid therethrough.

In an exemplary embodiment, a method for collecting backscattered electrons within a substantially evacuated vessel containing both an electron-emitting cathode assembly and an electron-attracting anode assembly spaced apart therein, said system comprising mounting a first plate proximate to said anode assembly within said vessel, said first plate having a first side at least partially facing said anode assembly and a second side facing opposite said first side; mounting a second plate proximate to said cathode assembly within said vessel, said second plate having a first side and a second side at least partially facing said cathode assembly; and positioning an inner member between said first plate and said second plate, said inner member having an internal conduit for conveying heat absorbing cooling fluid therethrough.

Various other features, aspects, embodiments and advantages will be made apparent to those skilled in the art from the accompanying drawings and detailed description thereof.

DETAILED DESCRIPTION OF THE INVENTION

Figure 1:
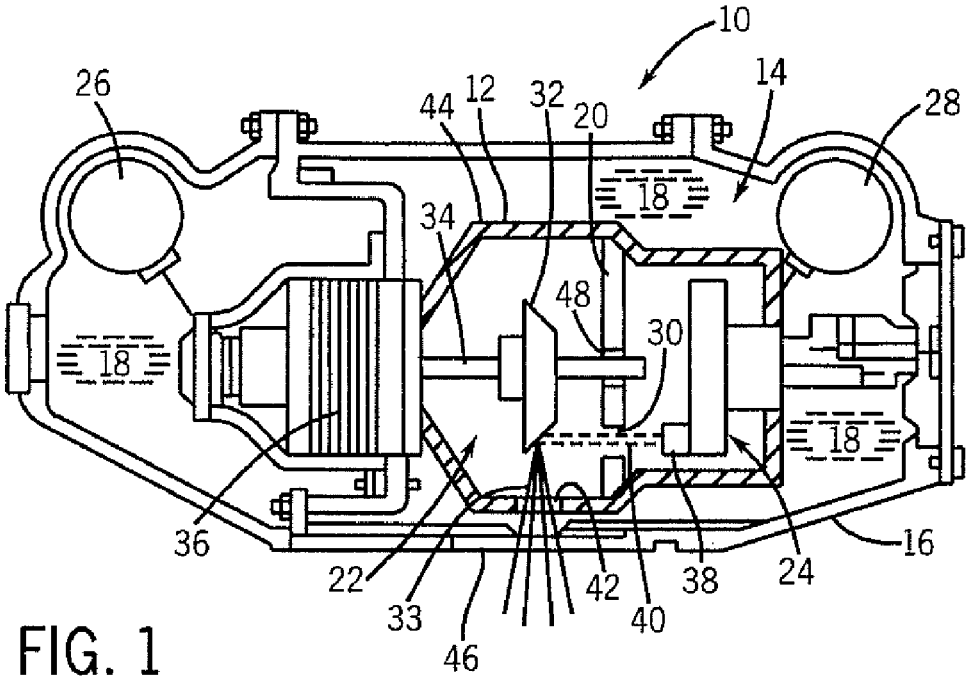
FIG. 1 is a cross-sectional view of an exemplary embodiment of an x-ray tube assembly.

FIG. 1 is a cross-sectional view of an exemplary embodiment of an x-ray tube assembly 10. The x-ray tube assembly 10 includes a substantially evacuated vacuum vessel 12 that is situated in a chamber 14 defined within a casing 16. The vacuum vessel 12 is constructed to endure very high temperatures and includes an anode assembly 22, a cathode assembly 24, and an electron collector assembly 20 positioned between the anode assembly 22 and the cathode assembly 24. The casing 16 may be lined with lead to shield and prevent any extraneous x-ray radiation from straying from the x-ray tube assembly 10. The chamber 14 within the casing 16 may be filled with a heat absorbing cooling fluid 18 such as, for example, a dielectric oil. The x-ray tube assembly 10 further includes a high voltage anode receptacle 26 and a high voltage cathode receptacle 28 that serve as connection points for an electrical power supply (not shown) for powering the x-ray tube assembly 10. The anode assembly 22 is in electrical communication with the high voltage anode receptacle 26 and the cathode assembly 24 in electrical communication with the high voltage cathode receptacle 28.

During operation of the x-ray tube assembly 10, the cooling fluid 18 is circulated through the chamber 14 by a pump (not shown). The circulating cooling fluid 18 absorbs heat from the vacuum vessel 12 and other components of the x-ray tube assembly 10, preventing damage thereto. In addition to absorbing heat from the vacuum vessel 12 and other components of the x-ray tube assembly 10, the cooling fluid 18 also provides electrical insulation between the high voltage anode receptacle 26 and the high voltage cathode receptacle 28, the casing 16 and the vacuum vessel 12.

The anode assembly 22 includes a rotating anode target 32 mounted to one end of a rotatable shaft 34. The opposite end of the rotatable shaft 34 is coupled to a motor 36 that rotates the rotatable shaft 34 and anode target 32 at a very high angular velocity. The rotatable shaft 34 extends from the motor 36 into the vacuum vessel 12 with the anode target 32 attached to the end thereof. The cathode assembly 24 includes a cathode filament 38 situated opposite the anode target 32 within the vacuum vessel 12.

During operation, when the x-ray assembly 10 is energized by the electrical power supply (not shown) electrically connected between the anode assembly 22 and the cathode assembly 24, a focused beam of electrons 40 is emitted from the cathode filament 38 of the cathode assembly 24 and directed toward the anode target 32 of the anode assembly 22. As the electron beam 40 strikes the target track of the rotating anode target 32, x-rays 33 are generated. The generated x-rays 33 then pass through a first x-ray transmissive window 42 in the wall 44 of the vacuum vessel 12, and through a second x-ray transmissive window 46 in the casing 16 of the x-ray tube assembly 10.

The electron collector assembly 20 is attached to the wall 44 of the vacuum vessel 12. The electron collector assembly 20 may include an opening 48 extending therethrough allowing one end of the rotatable shaft 34 to extend through the electron collector assembly 20 and allowing the rotatable shaft 34 to rotate, and an aperture 30 extending therethrough for allowing an electron beam 40 from the cathode filament 38 to pass therethrough to the anode target 32.

Any backscattered electrons and off-focus x-ray radiation from the anode target 32 are collected by the electron collector assembly 20 positioned between the anode assembly 22 and cathode assembly 24. The electron collector assembly 20 further prevents any backscattered electrons from re-impacting the anode target 32 and producing additional off-focus x-ray radiation, which may cause undesirable x-ray radiation exposure and negatively affect the quality of an x-ray image.

Figure 2:
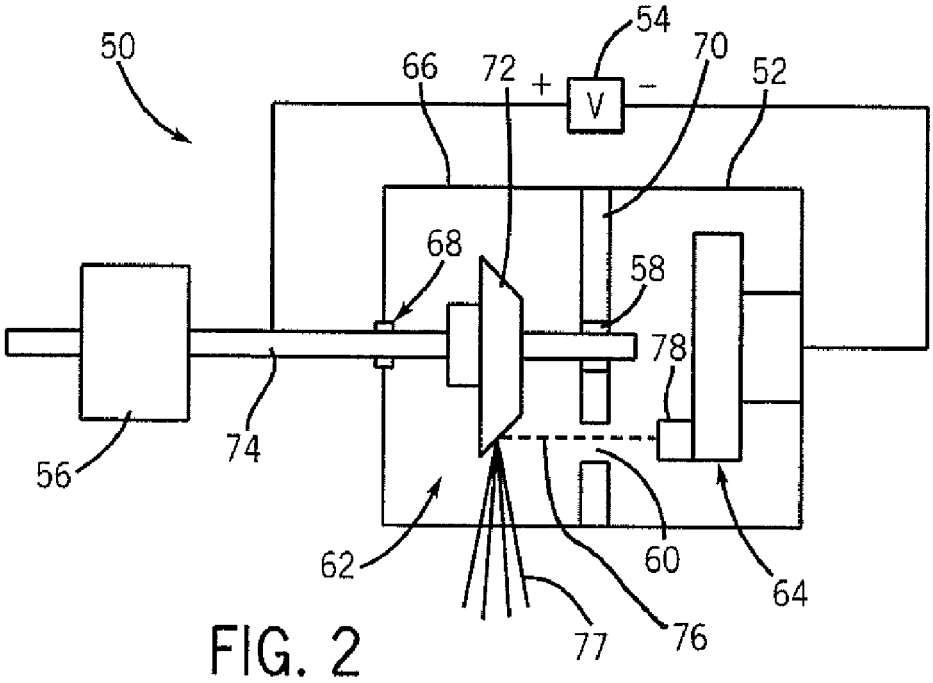
FIG. 2 is a schematic diagram of an exemplary embodiment of an x-ray tube.

FIG. 2 is a schematic diagram of an exemplary embodiment of an x-ray tube 50. The x-ray tube 50 includes a substantially evacuated vacuum vessel 52, an electrical power supply 54, and a motor 56. The vacuum vessel 52 includes an anode assembly 62, a cathode assembly 64, and an electron collector assembly 70 positioned between the anode assembly 62 and the cathode assembly 64.

Figure 3:
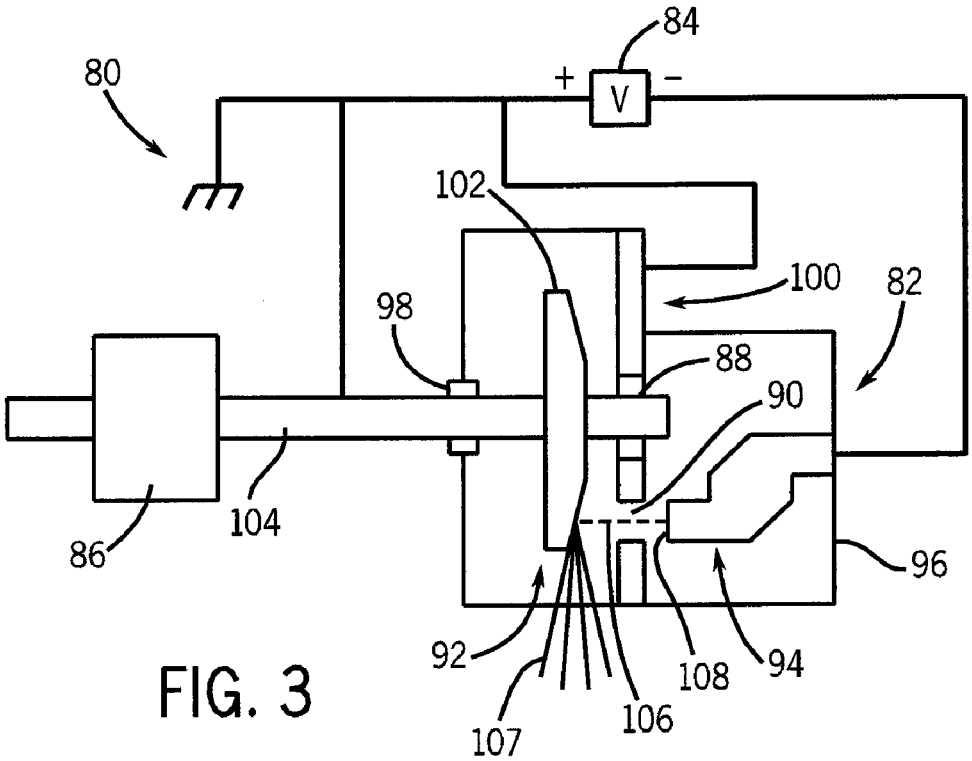
FIG. 3 is a schematic diagram of an exemplary embodiment of an x-ray tube.

The electrical power supply 54 is connected between the anode assembly 62 and the cathode assembly 64. An x-ray tube may typically be of a bi-polar configuration or a monopolar configuration. The x-ray tube 50 shown in FIG. 2 most closely resembles that of a bi-polar configuration. In a bi-polar configuration, for example, the cathode is maintained at a negative voltage and the anode is maintained at a positive voltage. FIG. 3 illustrates a schematic diagram of an x-ray tube 80 in a monopolar configuration.

The anode assembly 62 includes an anode target 72 mounted to one end of a rotatable shaft 74. The opposite end of the rotatable shaft 74 is coupled to the motor 56 that rotates the rotatable shaft 74 and anode target 72 at a very high angular velocity. The rotatable shaft 74 extends from the motor 56 into the vacuum vessel 52 with the anode target 72 attached to the end thereof. A seal and bearing assembly 68 is coupled to the rotatable shaft 74 at the vacuum vessel 52 to substantially keep the vacuum vessel 52 hermetically sealed and allowing the rotatable shaft 74 to rotate. The cathode assembly 64 includes a cathode filament 78 situated opposite the anode target 72 within the vacuum vessel 52.

The electron collector assembly 70 is attached to the wall 66 of the vacuum vessel 52. The electron collector assembly 70 may include an opening 58 extending therethrough allowing one end of the rotatable shaft 74 to extend through the electron collector assembly 70 and allowing the rotatable shaft 74 to rotate, and an aperture 60 extending therethrough for allowing an electron beam 76 from the cathode filament 78 to pass therethrough to the anode target 72 for producing x-rays 77.

The electron collector assembly 70 is designed to collect any backscattered electrons and off focus x-ray radiation from the anode target 72. The electron collector assembly 70 further prevents any backscattered electrons from re-impacting the anode target 72 and producing additional off-focus x-ray radiation, which may cause undesirable x-ray radiation exposure and negatively affect the quality of an x-ray image.

FIG. 3 is a schematic diagram of an exemplary embodiment of an x-ray tube 80. The x-ray tube 80 includes a substantially evacuated vacuum vessel 82, an electrical power supply 84, and a motor 86. The vacuum vessel 82 includes an anode assembly 92, a cathode assembly 94, and an electron collector assembly 100 positioned between the anode assembly 92 and the cathode assembly 94.

The electrical power supply 84 is connected between the anode assembly 92 and the cathode assembly 94. The x-ray tube 80 shown in FIG. 3 most closely resembles that of a monopolar configuration. In a monopolar configuration, for example, the cathode is maintained at a negative high voltage and both the anode and vacuum vessel are electrically grounded.

The anode assembly 92 includes an anode target 102 mounted to one end of a rotatable shaft 104. The opposite end of the rotatable shaft 104 is coupled to the motor 86 that rotates the rotatable shaft 104 and anode target 102 at a very high angular velocity. The rotatable shaft 104 extends from the motor 86 into the vacuum vessel 82 with the anode target 102 attached to the end thereof. A seal and bearing assembly 98 is coupled to the rotatable shaft 104 at the vacuum vessel 82 to substantially keep the vacuum vessel 82 hermetically sealed and allowing the rotatable shaft 104 to rotate. The cathode assembly 94 includes a cathode filament 108 situated opposite the anode target 102 within the vacuum vessel 82.

The electron collector assembly 100 is attached to the wall 96 of the vacuum vessel 82. The electron collector assembly 100 may include an opening 88 extending therethrough allowing one end of the rotatable shaft 104 to extend through the electron collector assembly 100 and allowing the rotatable shaft 104 to rotate, and an aperture 90 extending therethrough for allowing an electron beam 106 from the cathode filament 108 to pass therethrough to the anode target 102 for producing x-rays 107.

The electron collector assembly 100 is designed to collect any backscattered electrons and off focus x-ray radiation from the anode target 102. The electron collector assembly 100 further prevents any backscattered electrons from re-impacting the anode target 102 and producing additional off-focus x-ray radiation, which may cause undesirable x-ray radiation exposure and negatively affect the quality of an x-ray image.

Figure 4:
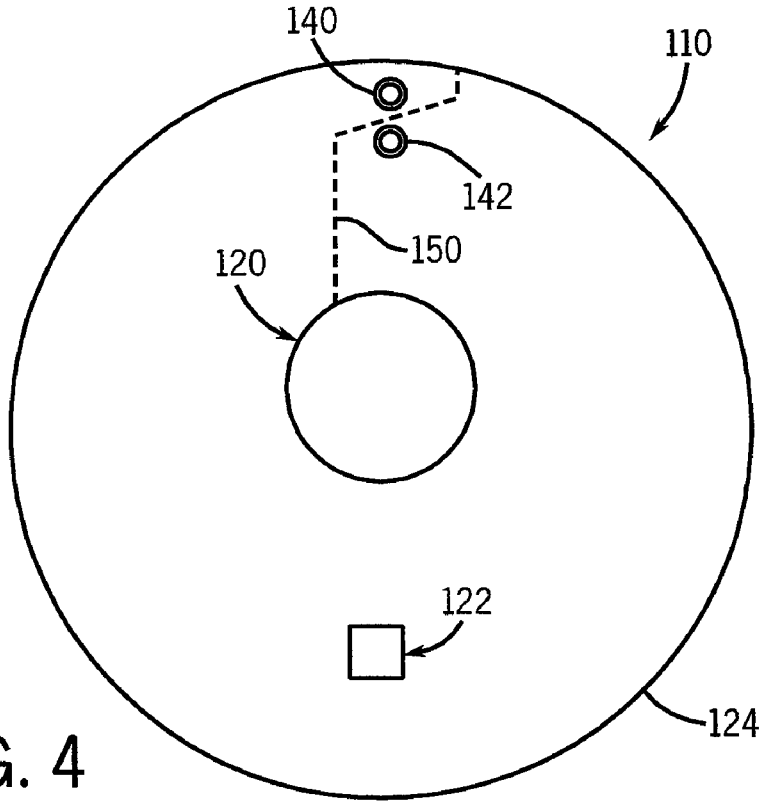
FIG. 4 is a plan view of an exemplary embodiment of an electron collector assembly.

FIG. 4 is a plan view of an exemplary embodiment of an electron collector assembly 110. The electron collector assembly 110 may include an opening 120 in the center thereof that extends therethrough for fitting around a shaft assembly from an anode assembly of an x-ray tube, an aperture 122 extending therethrough for allowing an electron beam from a cathode assembly of an x-ray tube to pass therethrough, and an outer periphery 124. Though the opening 120 is substantially circular and the aperture 122 is substantially square or rectangular as shown, the opening 120 and aperture 122 may have other shapes in alternative embodiments. Furthermore, though the electron collector assembly 120 as shown has a circular outer periphery 124 and is thus generally shaped as a disk, the electron collector assembly 120 may take on other shapes in alternative embodiments.

To facilitate the introduction of a heat absorbing cooling fluid into an internal conduit of the electron collector assembly 110, a fluid inlet 140 is mounted to one side 136 of the electron collector assembly 110 and is in fluid communication with the internal conduit within the electron collector assembly 110. In this way, cooling fluid may be circulated into the electron collector assembly's internal conduit via the fluid inlet 140. In addition, to facilitate the removal of the heat absorbing cooling fluid from the internal conduit of the electron collector assembly 110, a fluid outlet 142 is similarly mounted to one side 136 of the electron collector assembly 110 and is in fluid communication with the internal conduit within the electron collector assembly 110. In this way, cooling fluid may be circulated out of the electron collector assembly's internal conduit via the fluid outlet 142. Furthermore, to ensure that cooling fluid is fully circulated throughout the internal conduit of the electron collector assembly 110, a septum 150 extends through the electron collector assembly 110 from the opening 120 to the outer periphery 124. The septum 150 ensures the flow of cooling fluid into the fluid inlet 140 and the out of the fluid outlet 142.

Figure 5:
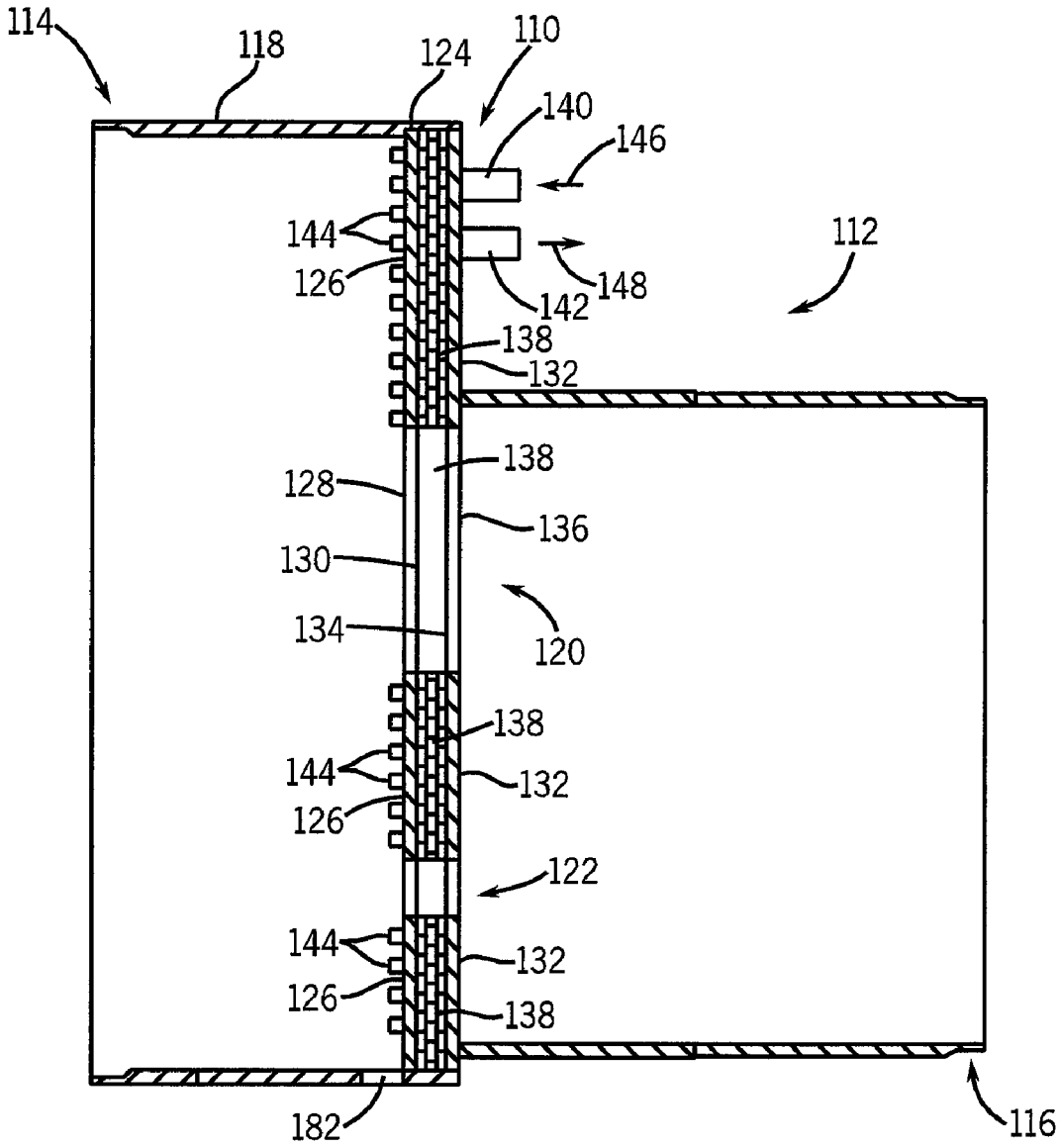
FIG. 5 is a cross-sectional view of an exemplary embodiment of the electron collector assembly of FIG. 4 mounted within a substantially evacuated vessel.

FIG. 5 is a cross-sectional view of the electron collector assembly 110 of FIG. 4 mounted within a substantially evacuated vessel, such as a vacuum vessel 112. The electron collector assembly 110 is generally centrally mounted within the vacuum vessel 112 that is suitable for incorporation within an x-ray tube. The vacuum vessel 112 includes an anode end 114 for acceptance of an anode assembly therein, a cathode end 116 for acceptance of a cathode assembly therein, and wall 118 enclosing the vacuum vessel 112.

The electron collector assembly 110 may include an opening 120 in the center thereof that extends therethrough for fitting around a shaft assembly from an anode assembly of an x-ray tube, an aperture 122 extending therethrough for allowing an electron beam from a cathode assembly of an x-ray tube to pass therethrough, and an outer periphery 124. The outer periphery 124 of the electron collector assembly 110 may be brazed, soldered, welded or otherwise attached to the wall 118 of the vacuum vessel 112 by any other type of physical attachment as well.

The electron collector assembly 110 is comprised of a first plate 126 having a first side 128 and a second side 130, a second plate 132 having a first side 134 and a second side 136, an inner member 138 positioned between the first plate 126 and the second plate 132, a fluid inlet 140, and a fluid outlet 142. The first plate 126 is generally both electrically conductive and thermally emissive, and is centrally mounted within the vacuum vessel 112. Though other constituent materials are possible, the first plate 126 may comprise an electrically conductive metal such as, for example, copper. The first plate 126 may also be coated with a thermally emissive outer coating such as, for example, an iron oxide coating. Furthermore, as illustrated in FIG. 4, the first plate 126 may include a plurality of thermally emissive protrusions 144 extending outwardly from its first side 128. As shown, the protrusions 144 generally extend outwardly toward the anode end 114 of the vacuum vessel 112. Though other constituent materials are possible, the protrusions 144 may comprise an electrically conductive metal such as, for example, copper. The protrusions 144 may also be coated with a thermally emissive outer coating such as, for example, an iron oxide coating. The second plate 132 is generally thermally emissive. Though other constituent materials are possible, the second plate 132 may comprise stainless steel and may be "greened" with a thermally emissive outer coating such as, for example, a chromic oxide coating.

The inner member 138 is sandwiched in between the second side 130 of the first plate 126 and the first side 134 of the second plate 132. The second side 130 of the first plate 126 is substantially conterminous with one side of the inner member 138, and the first side 134 of the second plate 132 is substantially conterminous with the opposite side of the inner member 138. The inner member 138 is in thermal conductive contact with the second side 130 of the first plate 126 and the first side 134 of the second plate 132.

In an exemplary embodiment, the inner member 138 may comprise an internal conduit having a plurality of thermally conductive projections protruding into the internal conduit and allowing a heat absorbing cooling fluid to flow therethrough. In an exemplary embodiment, the internal conduit may be in the form of a latticed structure. In an exemplary embodiment, the inner member 138 may comprise an internal conduit having a material with a plurality of recesses or openings extending therethrough in a sponge-like manner protruding into the internal conduit and allowing a heat absorbing cooling fluid to flow therethrough. In an exemplary embodiment, the internal conduit may be in the form of a sponge-like structure. Situated as such, the projections or sponge-like material are able to physically interact with the heat absorbing cooling fluid flowing through the internal conduit. The heat absorbing cooling fluid may be a liquid such as, for example, an oil, a dielectric oil, a mineral oil, or even a water-based coolant.

In an exemplary embodiment, the inner member 138 may be brazed, soldered, welded or otherwise attached to the second side 130 of the first plate 126 by any other type of physical attachment, and may be brazed, soldered, welded or otherwise attached to the first side 134 of the second plate 132 by any other type of physical attachment as well.

In an exemplary embodiment, the inner member 138 may be integral with the second side 130 of the first plate 126, and may be brazed, soldered, welded or otherwise attached to the first side 134 of the second plate 132 by any other type of physical attachment as well.

In an exemplary embodiment, the inner member 138 may be integral with the first side 134 of the second plate 132, and may be brazed, soldered, welded or otherwise attached to the second side 130 of a first plate 126 by any other type of physical attachment as well.

To facilitate introduction of a heat absorbing cooling fluid into the inner member's 138 internal conduit, the aforementioned fluid inlet 140 is mounted on the second side 136 of the second plate 132 to be in fluid communication with the inner member's 138 internal conduit. In this way, cooling fluid may be circulated into the inner member's 138 internal conduit via fluid inlet 140 in a direction indicated by arrow 146. In addition, to help facilitate removal of the heat absorbing cooling fluid from the inner member's 138 internal conduit, the fluid outlet 142 is similarly mounted on the second side 136 of the second plate 132 to also be in fluid communication with the inner member's 138 internal conduit. In this way, cooling fluid may be circulated out of the internal conduit and away from the second plate 132 via fluid outlet 142 in a direction indicated by arrow 148. Furthermore, to ensure that cooling fluid is fully circulated throughout the internal conduit of the inner member 138, the inner member 138 includes a septum 150 within the internal conduit. The septum 150 ensures the flow of cooling fluid into the fluid inlet 140 and the out of the fluid outlet 142.

Figure 6:
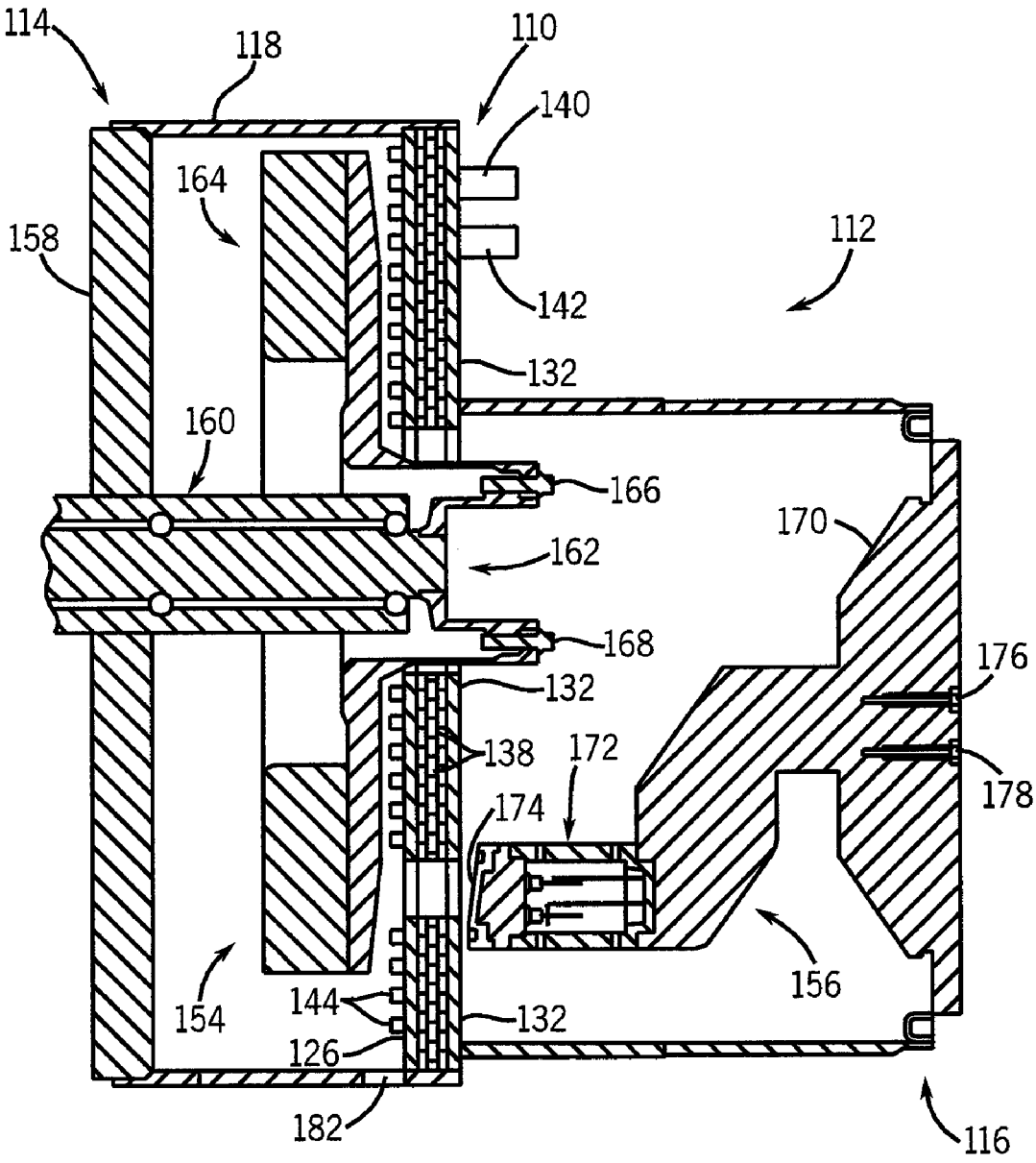
FIG. 6 is a cross-sectional view of the electron collector assembly of FIG. 5 mounted within the vacuum vessel of an x-ray tube.

FIG. 6 is a cross-sectional view of the electron collector assembly 110 of FIG. 5, mounted within the vacuum vessel 112 of an x-ray tube. In FIG. 6, an anode assembly 154 is mounted and installed in the anode end 114 of the vacuum vessel 112, and a cathode assembly 156 is installed in a cathode end 116 of the vacuum vessel 112. In such a configuration, the electron collector assembly 110 is thereby interposed and mounted between the anode assembly 154 and the cathode assembly 156.

As shown in FIG. 6, the anode assembly 154 generally includes an anode assembly mount 158, a seal and bearing assembly 160, a rotatable shaft 162, and an anode target 164. The mount 158 is generally installed and welded within the vacuum vessel's anode end 114 to keep the vacuum vessel 112 hermetically sealed. The seal and bearing assembly 160, is disposed within the mount 158 to support an extension of the shaft 162. The seal and bearing assembly 160 also facilitates rotation of the shaft 162 while at the same time maintaining the vacuum vessel's hermetic seal. As further shown in FIG. 5, the anode target 164 is fixedly mounted on the end of the shaft 162 with fasteners 166 and 168. The opening 120 in the electron collector assembly 110 physically accommodates the shaft 162 by permitting the shaft 162 to freely protrude through the opening 120.

As additionally shown in FIG. 6, the cathode assembly 156 generally includes a cathode assembly mount 170 and an electron emitter 172. The mount 170 is generally installed and welded within the vacuum vessel's cathode end 116 to keep the vacuum vessel 112 hermetically sealed. The mount 170 includes electrical connectors 176 and 178 for connecting the cathode assembly 156 to an electrical power supply. The electron emitter 172, includes an energizable cathode filament 174 mounted to the end of the electron emitter 172 and extending toward the aperture 122 extending through the electron collector assembly 110.

The thermally emissive coating on the first plate 126 and on the protrusions 144 allow the first plate 126 and protrusions 144 to absorb radiant heat from the anode target 164, resulting in decreased temperature of critical components of the x-ray tube. In addition, the thermally emissive coating on the second plate 132 allows the second plate 132 to absorb radiant heat from the cathode assembly 156, resulting in decreased temperature of critical components of the x-ray tube.

Figure 7:
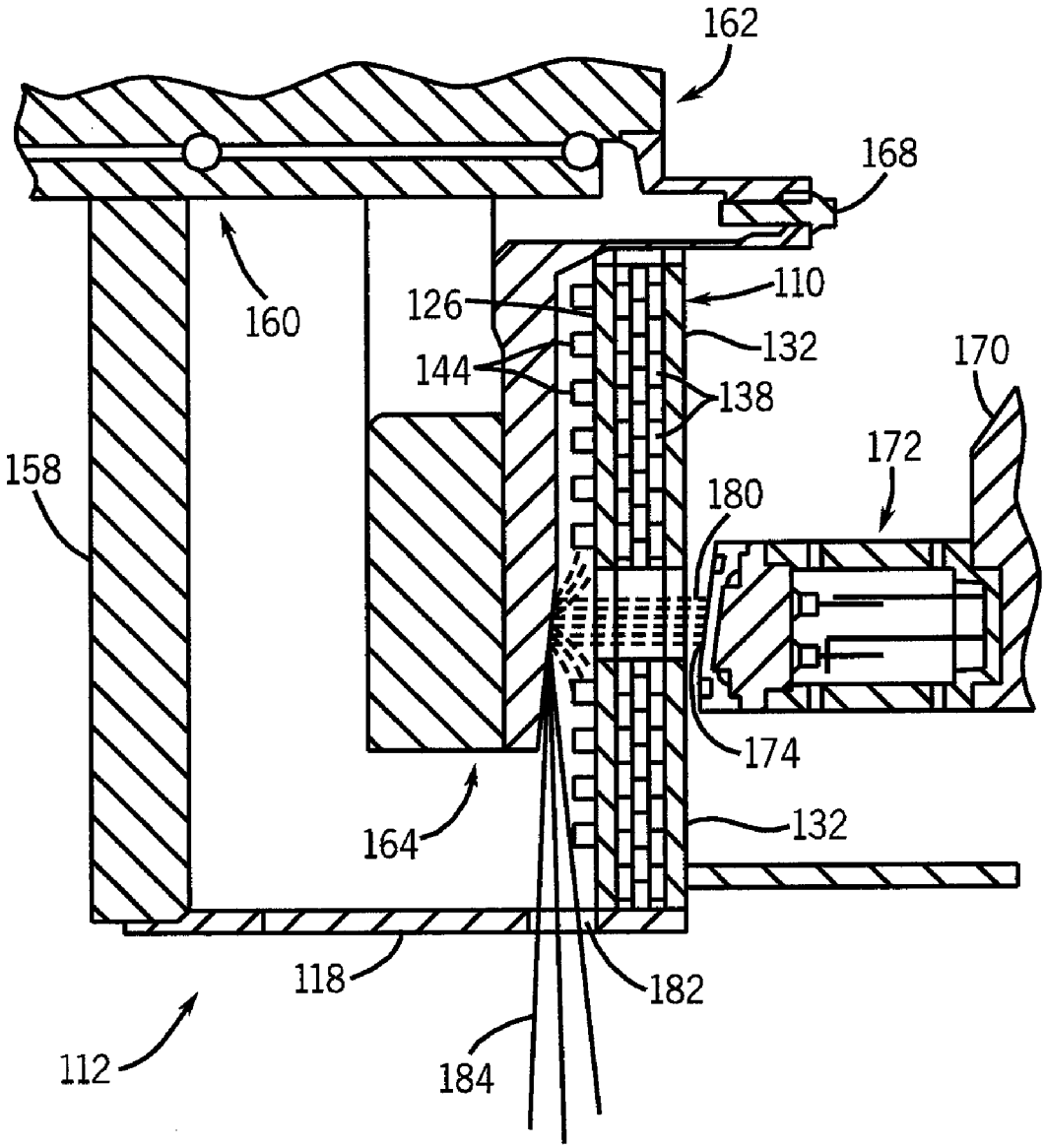
FIG. 7 is an enlarged cross-sectional view of the electron collector assembly of FIG. 6.

FIG. 7 is an enlarged cross-sectional view of the electron collector assembly 110 of FIG. 6. During operation of the x-ray tube, a focused electron beam 180 is emitted from the cathode filament 174 and accelerated through the aperture 122 toward the anode target 164. As the electron beam 180 strikes the anode target 164, x-rays 184 are produced in all directions. A portion of the x-rays 184 are directed out of an x-ray transmissive window 182. The portion of the x-rays that are not directed out of the x-ray transmissive window 182, so called off-focus x-ray radiation, are collected or absorbed by the electron collector assembly 110.

Many of the electrons striking the anode target 164 are backscattered from the target surface in many different directions. Since the first plate 126 of the electron collector assembly 110 is electrically charged by the electrical power supply 54, 84 illustrated in FIGS. 2 and 3, many of these backscattered electrons are electrostatically attracted to the first plate 116. As the backscattered electrons are attracted to the first plate 116, the electrons ultimately impinge on the first plate 116 and transfer their respective kinetic energies to the first plate 116 in the form of thermal energy or heat. Since the first plate 126 is in thermally conductive contact with the inner member 138, the thermal energy attributable to impinging electrons in the first plate 126 is thereby transferred to the heat absorbing cooling fluid that is flowing through the internal conduit of the inner member 138. In this way, the thermal energy attributable to backscattered electrons is effectively removed from the electron collector assembly 110 and the vacuum vessel 112.

Furthermore, in addition to producing x-rays 184 and backscattered electrons, the anode target 164 radiates large amounts of heat. By design, much of this radiant heat is effectively absorbed by the plurality of protrusions 144 extending from the first side 128 of the first plate 126. As the radiant heat is absorbed, thermal energy attributable thereto is transferred from the first plate 126 and to the heat absorbing cooling fluid circulating through the inner member's 138 internal conduit so that the thermal energy attributable to the anode target 164 is effectively removed from the electron collector assembly 110 and the vacuum vessel 112.

In addition to the embodiments discussed above, it is to be understood that the electron collector assembly may take on various alternative embodiments as well. For example, in addition to the first plate having a plurality of protrusions protruding from its first side, the second plate may similarly have a plurality of thermally emissive protrusions protruding from its second side. Furthermore, though the electron collector assembly described hereinabove largely comprises two separate plates and an inner member that are joined together, it is to be understood that the electron collector assembly may alternatively comprise two plates and an inner member that are substantially integral with each other or even a single substantially monolithic plate. In an exemplary embodiment comprising a single monolithic plate, for example, the plate itself may comprise an electrically conductive metal and be thermally emissive. Such a monolithic plate may have a plurality of thermally emissive protrusions protruding from a first side, a second side, or both the first and second sides, and an internal conduit sandwiched between the first and second sides of the plate, the internal conduit allowing a heat absorbing cooling fluid to flow therethrough. In an exemplary embodiment comprising a single monolithic plate, for example, the plate itself may comprise an electrically conductive metal and be thermally emissive. Such a monolithic plate may have a plurality of thermally emissive protrusions protruding from a first side, and a conduit on the second side allowing a heat absorbing cooling fluid to flow therethrough.

While the disclosure has been described with reference to various embodiments, those skilled in the art will appreciate that certain substitutions, alterations and omissions may be made to the embodiments without departing from the spirit of the disclosure. Accordingly, the foregoing description is meant to be exemplary only, and should not limit the scope of the disclosure as set forth in the following claims.

What is claimed is:

1. An electron collector assembly for collecting backscattered electrons within a substantially evacuated vessel that contains an electron-emitting cathode and an electron-attracting anode spaced apart therein, said electron collector assembly comprising:

a first plate mounted proximate to said anode within said vessel, said first plate having a first side at least partially facing said anode and a second side facing opposite said first side;

a second plate mounted proximate to said cathode within said vessel, said second plate having a first side and a second side at least partially facing said cathode;

an inner member positioned between said first plate and said second plate, said inner member having an internal conduit for conveying a heat absorbing cooling fluid therethrough;

an inlet in fluid communication with said internal conduit; and an outlet in fluid communication with said internal conduit;

wherein the second side of the first plate is substantially conterminous with a first side of the inner member, and the first side of the second plate is substantially conterminous with a second side, opposite the first side of the inner member.

2. The electron collector assembly of claim 1, wherein said heat absorbing cooling fluid is circulated into said internal conduit via said inlet, and said heat absorbing cooling fluid is circulated out of said internal conduit via said outlet.

3. The electron collector assembly of claim 1, wherein said first plate, said second plate and said inner member each have an opening extending therethrough, said openings in said first plate, said second plate, and said inner member are substantially aligned so as to cooperatively permit a rotatable shaft of said anode assembly to freely protrude through said electron collector assembly.

4. The electron collector assembly of claim 1, wherein said first plate has a plurality of thermally emissive protrusions extending outwardly from said first side of said first plate.

5. The electron collector assembly of claim 1, wherein said first plate, said second plate and said inner member each have an aperture extending therethrough, said apertures in said first plate, said second plate, and said inner member are substantially aligned so as to cooperatively permit electrons to freely pass through said electron collector assembly.

6. The electron collector assembly of claim 1, wherein said first plate and said inner member are substantially integral with each other.

7. The electron collector assembly of claim 1, wherein said second plate and said inner member are substantially integral with each other.

8. The electron collector assembly of claim 1, wherein said heat absorbing cooling fluid is a liquid selected from the group consisting of an oil, a dielectric oil, a mineral oil, and a water-based coolant.

9. The electron collector assembly of claim 1, wherein said internal conduit includes a plurality of thermally conductive projections protruding into the internal conduit and allowing the heat absorbing cooling fluid to flow therethrough.

10. The electron collector assembly of claim 1, wherein said internal conduit is in the form of a latticed structure.

11. The electron collector assembly of claim 1, wherein said internal conduit includes a material with a plurality of recesses or openings extending therethrough in a sponge-like manner protruding into the internal conduit and allowing the heat absorbing cooling fluid to flow therethrough.

12. The electron collector assembly of claim 1, wherein said internal conduit is in the form of a sponge-like structure.

13. The electron collector assembly of claim 1, wherein said inner member is integral with said second side of said first plate, and attached to said first side of said second plate.

14. The electron collector assembly of claim 1, wherein said inner member is integral with said first side of said second plate, and attached to said second side of said first plate.

15. An electron collector assembly for collecting backscattered electrons within a substantially evacuated vessel that contains an electron-emitting cathode and an electron-attracting anode spaced apart therein, said electron collector assembly comprising:

a first plate mounted proximate to said anode within said vessel, said first plate having a first side at least partially facing said anode and a second side facing opposite said first side;

an inner member integral with said first plate, said inner member having an internal conduit for conveying a heat absorbing cooling fluid therethrough;

a second plate mounted proximate to said cathode within said vessel, said second plate having a first side and a second side at least partially facing said cathode;

an inlet in fluid communication with said internal conduit; and an outlet in fluid communication with said internal conduit;

wherein the second side of the first plate is substantially conterminous with a first side of the inner member, and the first side of the second plate is substantially conterminous with a second side, opposite the first side of the inner member.

16. An electron collector assembly for collecting backscattered electrons within a substantially evacuated vessel that contains an electron-emitting cathode and an electron-attracting anode spaced apart therein, said electron collector assembly comprising:

a first plate mounted proximate to said anode within said vessel, said first plate having a first side at least partially facing said anode and a second side facing opposite said first side;

a second plate mounted proximate to said cathode within said vessel, said second plate having a first side and a second side at least partially facing said cathode;

an inner member integral with said second plate, said inner member having an internal conduit for conveying heat absorbing cooling fluid therethrough;

an inlet in fluid communication with said internal conduit; and an outlet in fluid communication with said internal conduit;

wherein the second side of the first plate is substantially conterminous with a first side of the inner member, and the first side of the second plate is substantially conterminous with a second side, opposite the first side of the inner member.

17. A system for collecting backscattered electrons within a substantially evacuated vessel containing both an electron-emitting cathode assembly and an electron-attracting anode assembly spaced apart therein, said system comprising:

a first plate mounted proximate to said anode assembly within said vessel, said first plate having a first side at least partially facing said anode assembly and a second side facing opposite said first side;

a second plate mounted proximate to said cathode assembly within said vessel, said second plate having a first side and a second side at least partially facing said cathode assembly; and an inner member positioned between said first plate and said second plate, said inner member having an internal conduit for conveying heat absorbing cooling fluid therethrough;

wherein the second side of the first plate is substantially conterminous with a first side of the inner member, and the first side of the second plate is substantially conterminous with a second side, opposite the first side of the inner member.

18. A method for collecting backscattered electrons within a substantially evacuated vessel containing both an electron-emitting cathode assembly and an electron-attracting anode assembly spaced apart therein, said system comprising:

mounting a first plate proximate to said anode assembly within said vessel, said first plate having a first side at least partially facing said anode assembly and a second side facing opposite said first side;

mounting a second plate proximate to said cathode assembly within said vessel, said second plate having a first side and a second side at least partially facing said cathode assembly; and positioning an inner member between said first plate and said second plate, said inner member having an internal conduit for conveying heat absorbing cooling fluid therethrough;

wherein the second side of the first plate is substantially conterminous with a first side of the inner member, and the first side of the second plate is substantially conterminous with a second side, opposite the first side of the inner member.

* * * * *